United States Patent [19]

Muncey

[11] Patent Number: 4,772,209

[45] Date of Patent: Sep. 20, 1988

[54] ADAPTER BULB FOR PROVIDING EXTERNAL ELECTRICAL CONNECTION BETWEEN POWERED VEHICLES AND TRAILERS

[76] Inventor: Arthur L. Muncey, 1528 Richwood La., Port Richey, Fla. 33568

[21] Appl. No.: 49,546

[22] Filed: May 14, 1987

[51] Int. Cl.[4] ..... H01R 33/46

[52] U.S. Cl. ..... 439/36; 313/318

[58] Field of Search ..... 439/36, 503, 615, 638, 439/683; 313/318

[56] References Cited

U.S. PATENT DOCUMENTS

| | | | |
|---|---|---|---|
| 501,580 | 7/1893 | Sachs | 439/638 |
| 3,137,448 | 6/1964 | Holzhause | 439/639 X |
| 3,400,293 | 9/1968 | Reichardt | 313/318 |

*Primary Examiner*—Eugene F. Desmond

*Attorney, Agent, or Firm*—Leon Gilden

[57] ABSTRACT

An adapter bulb and connecting assembly facilitates an external electrical connection between a vehicle electrical system and the tail-lights of a trailer being towed by the vehicle.

1 Claim, 2 Drawing Sheets

ADAPTER BULB FOR PROVIDING EXTERNAL ELECTRICAL CONNECTION BETWEEN POWERED VEHICLES AND TRAILERS

BACKGROUND OF THE INVENTION

1. Field of the Invention

The present invention relates to vehicle illumination systems, and more particularly pertains to a new and improved tail-light assembly which facilitates an external electrical connection between a powered vehicle and a trailer towed thereby.

2. Description of the Prior Art

The use of adapter bulbs providing an external electrical connection between a powered vehicle and a trailer is known in the prior art. In this respect, reference is made to two U.S. Patents which issued to H. Reichardt, i.e., U.S. Pat. No. 3,335,389 having an issue date of Aug. 8, 1967 and U.S. Pat. No. 3,400,293 having an issue date of Sept. 3, 1968. Both of these Reichardt patents deal with an adapter bulb assembly for providing an external electrical connection between a vehicle and its towed trailer.

In the first mentioned patent, the inventor envisions the use of a specially designed lamp receiving socket on the vehicle. In this respect, longitudinal grooves are formed on an interior surface of the socket with additional pigtail electrical leads then being retained within these grooves in a noninterfering relationship with a tail-light bulb inserted within the socket. While being functional for its intended purpose, it can be appreciated that this particular design requires the permanent mounting of the specially designed sockets on the powered vehicle and as such, the interchangeable use of different vehicles would not be possible with the same trailer.

In the second mentioned patent, Reichardt attempts a direct modification to a taillight bulb which would then facilitate the use of any powered vehicle in combination with a trailer being towed by such vehicle. However, it will be noted with respect to the second design that a substantially complex modification of a light bulb is required inasmuch as the electrical pigtail leads are directly connected to the bulb filament leads and extend outwardly and over the lip of the metallic connection base which holds the evacuated glass envelope in which the bulb filaments retained. Present sealing and manufacturing techniques utilized in the industry would most likely result in damage to the extending pigtail leads so as to create short or open circuits, and this fact may account for the lack of commercial success of the invention as disclosed. Further, this second type of bulb adapter requires the use of four of these specially manufactured bulbs to effect an interconnection of the vehicle taillights with the trailer bulb receiving sockets, and accordingly, the expense of utilizing this system is increased due to the requirement of a user having to purchase at least four of the specially manufactured assemblies.

As such, there appears to be a continuing need for new and improved adapter bulb assemblies which would provide an external electrical connection between a powered vehicle and a trailer towed thereby, and in this respect, the present invention fulfills this need.

SUMMARY OF THE INVENTION

In view of the foregoing disadvantages inherent in the known types of adapter bulbs for providing an external electrical connection between powered vehicles and trailers now present in the prior art, the present invention provides an improved adapter bulb assembly wherein only two such bulbs are required to effect an electrical interconnection between a powered vehicle and its towed trailer, and further wherein such bulbs are designed to prevent short or open circuits in their outwardly extending pigtail electrical leads. As such, the general purpose of the present invention, which will be described subsequently in greater detail, is to provide a new and improved adapter bulb assembly which has all the advantages of the prior art adapter bulb assemblies and none of the disadvantages.

To attain this, the present invention utilizes a conventional dual filament tail-light bulb which has a through-extending aperture formed in its metallic casing. A pair of pigtail wires are directed through the aperture and are held in position by a rubber grommet fixedly secured within the aperture. The pigtail leads are respectively connected to the bulb filament hot wires, and the opposed ends of the leads terminate in a bayonet connector. The invention further includes an adapter for effecting electrical interconnection between the vehicle taillight socket with this adapter being substantially similar in design to the base of a taillight bulb. Pigtail leads extending outwardly from the adapter also terminate in a bayonet connector, and the two bayonet connectors may then be interconnected to effect an electrical interconnection between the vehicle tail-light socket and the specially adapted bulb. The bulb may then be inserted into a socket assembly or some other holding device attached to the trailer. An actuation of the vehicle tail-lights is then transmitted to the special bulb attached to the trailer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the It is therefore an object of the present invention to provide a new and improved taillight adapter bulb which has all the advantages of the prior art tail-light adapter bulbs and none of the disadvantages.

It is another object of the present invention to provide a new and improved tail-light adapter bulb which may be easily and efficiently manufactured and marketed.

It is a further object of the present invention to provide a new and improved taillight adapter bulb which is of a durable and reliable construction.

An even further object of the present invention is to provide a new and improved tail-light adapter bulb which is susceptible of a low cost of manufacture with regard to both materials and labor, and which accordingly is then susceptible of low prices of sale to the consuming public, thereby making such taillight adapter bulbs economically available to the buying public.

Still yet another object of the present invention is to provide a new and improved tail-light adapter bulb which provides in the apparatuses and methods of the prior art some of the advantages thereof, while simultaneously overcoming some of the disadvantages normally associated therewith.

Still another object of the present invention is to provide a new and improved tail-light adapter bulb which operates as an efficient coupling device for making electrical connection between powered vehicles and trailers.

Yet another object of the present invention is to provide a new and improved tail-light adapter bulb which permits an external adjunctive electrical connection between powered vehicles and trailers in as much as said bulb is designed to fit in a conventional tail-light socket assembly.

These together with other objects of the invention; along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
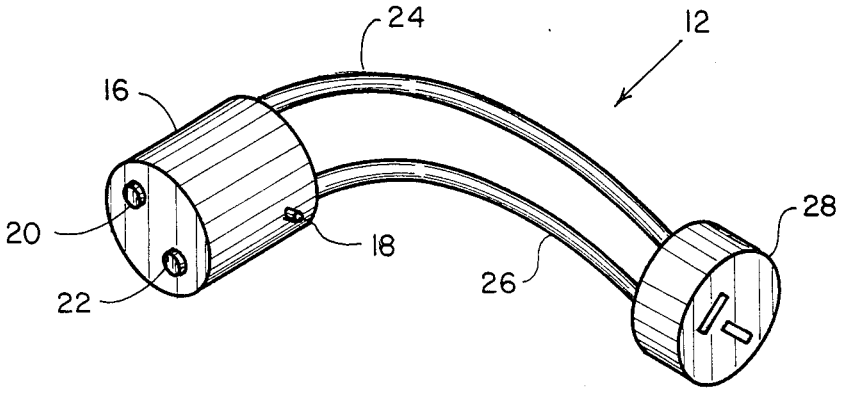
FIG. 1 is a perspective view of the vehicle adapter utilized in the combination of the present invention.
Figure 2:
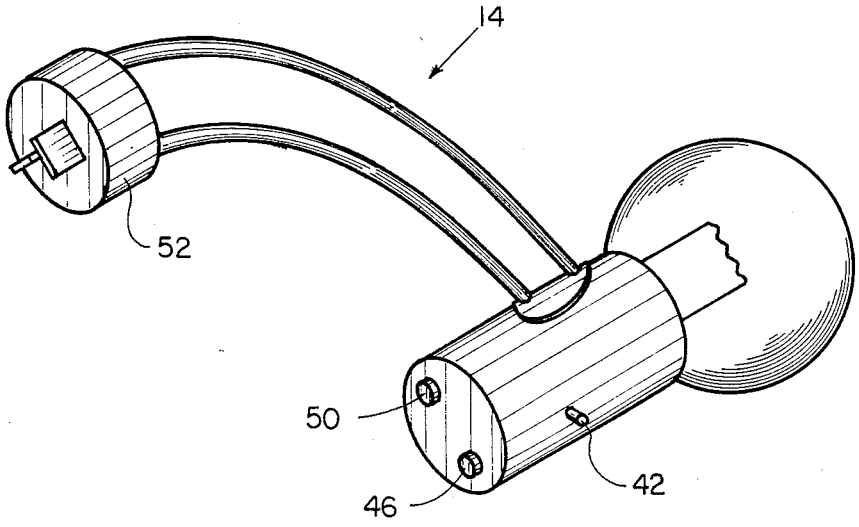
FIG. 2 is a perspective view of the specially designed adapter bulb utilized in the combination of the present invention.
Figure 3:
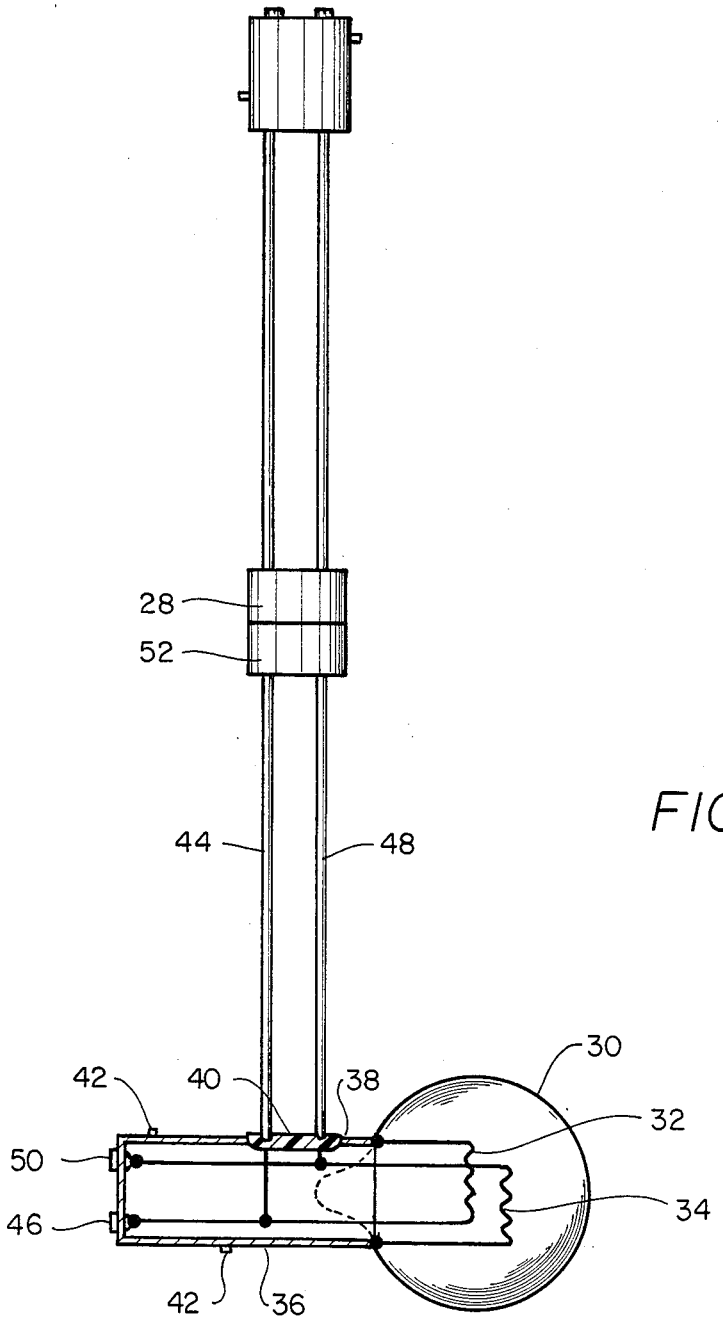
FIG. 3 is a side elevation view, partly in cross section, illustrating the assembled invention.

With reference now to the drawings, and in particular to FIGS. 1, 2 and 3 thereof, a new and improved tail-light adapter bulb assembly embodying the principles and concepts of the present invention and generally designated by the reference numeral 10 will be described.

More specifically, it will be noted that the tail-light adapter bulb assembly 10 includes an adapter 12 and a specially designed tail-light bulb 14. The adapter 12 includes a metallic base member 16 having outwardly extending conventional detents 18 for effecting a connection of the base within a conventional taillight socket located on a vehicle. The base 16 includes a first contact 20 in electrical communication with the vehicle tail-light system and a second contact 22 in electrical communication with the vehicle brake light system. The ground connection of the base is established by the metallic detents 18 as well as the metallic construction of the base per se.

A first electrical pigtail lead 24 extending out of the base 16 is electrically connected to the tail-light contact 20 and a second electrical lead 26 is in electrical communication with the contact 22. The remaining free ends of the electric wires 24, 26 terminate in a conventional bayonet connector 28.

As best illustrated in FIGS. 2 and 3, the specially designed bulb 14 includes an evacuated glass envelope 30 having a taillight filament 32 and a stop light filament 34 conventionally retained therein. Additionally, the bulb 14 includes an extended metallic base 36 which is substantially longer than conventional metallic bases, with this base including a through-extending aperture 38 formed on a circumferential wall portion thereof. A rubber gasket or grommet 40 is sealingly, permanently affixed within the aperture 38, while the base is further provided with outwardly extending conventional detents for effecting an interconnection of the base with a vehicle light bulb retaining socket. A first electrical pigtail lead 44 is directed though the grommet 40 and is electrically connected to the taillight lead and its associated contact 46. Similarly, a second electrical pigtail lead 48 is directed through the grommet 40 and is electrically attached to the stop or brake light lead and contact arrangement 50. The remaining free ends of the electrical leads 44, 48 terminate in a further bayonet connector 52.

As to the manner of usage and operation of the present invention, the same should be apparent from the above description. However, a brief summary thereof will be provided. More specifically, it can be appreciated that the present invention 10 dispenses with the need of electrical wiring on a towed trailer. At most, only bulb retaining sockets need to be utilized on the trailer, and even these could be dispensed with provided that a secure ground connection could be established between a bulb assembly 14 and the trailer frame. In any event, a user of the invention needs only to remove the tail-light covers on his vehicle, and after removing the associated taillight bulbs from the vehicle, the connector base 16 can be positioned in each of the vehicle taillight sockets. With the bulb assemblies 14 operably installed in the bulb holding sockets permanently attached to the trailer, the connectors 52, 28 may then be joined together to establish electrical communication between the vehicle and the bulb assembly 14. As such, an actuation of the vehilce tail and brake lights will be transferred to the bulb assemblies 14 now attached to the back of the trailer. As is apparent, only two bulb assemblies 14 are required to complete the assembly, since the vehicle tail and stop lights become essentially superfluous in a trailer that is being towed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved adapter bulb assembly for providing an external electrical connection between a powered vehicle and a trailer towed thereby, said assembly comprising:

bulb means;

first connector means removably positionable within a tail-light receiving socket associated with said vehicle;

first electrical lead means of finite length including first and second ends in electrical communication with said first connector means at said first ends and extending outwardly therefrom;

second connector means attached to said first electrical lead means at said second ends and being in electrical communication therewith;

second electrical lead means of finite length including first and second ends attached to and being in electrical communication with filament means forming a part of said bulb means at said first ends;

said second electrical lead means extending outwardly through an aperture formed through a metallic base portion of said bulb means said bulb means further including a rubber grommet positioned in said aperture, said second electrical lead means extending through said rubber grommet, and, third connector means attached to said second ends of said second electrical lead means and being in electrical communication therewith, and wherein said second and third connector means comprise separable connectors which may be selectively joined together to establish electrical communication between said first and second electrical lead means, and further including fourth connector means attachable to said trailer, said bulb means being positionable in said fourth connector means, and wherein said fourth connector means comprises a tail-light receiving socket attached to said trailer.

* * * * *